US005203409A

United States Patent [19]

Seid et al.

[11] Patent Number: 5,203,409

[45] Date of Patent: Apr. 20, 1993

[54] GEOTHERMAL WELL APPARATUS AND ECCENTRIC HANGER SPOOL THEREFOR

[75] Inventors: G. Ray Seid, Houston; Joe E. Wilson, Missouri City; John B. Williams, Jr., Houston, all of Tex.

[73] Assignee: Cooper Industries, Inc., Houston, Tex.

[21] Appl. No.: 826,087

[22] Filed: Jan. 27, 1992

[51] Int. Cl.[5] ..... E21B 33/03

[52] U.S. Cl. ..... 166/86; 166/88

[58] Field of Search ..... 166/72, 97.5, 77, 86, 166/120, 133, 152, 384, 386, 250

[56] References Cited

U.S. PATENT DOCUMENTS

| | | | |
|---|---|---|---|
| 2,794,505 | 6/1957 | Allen | 166/86 |
| 3,042,427 | 7/1962 | Word, Jr. | 166/97.5 |
| 3,050,120 | 8/1962 | McSpadden | 166/86 |
| 3,095,007 | 6/1963 | Allen | 166/97.5 X |
| 3,095,927 | 7/1963 | Rhodes | 166/97.5 |
| 3,166,345 | 1/1965 | Pinkard | 166/86 |
| 3,357,491 | 12/1967 | Jones et al. | 166/97.5 |
| 3,409,084 | 11/1968 | Lawson, Jr. et al. | 166/86 |
| 3,976,130 | 8/1976 | Chambless et al. | 166/84 |
| 4,189,003 | 2/1980 | James et al. | 166/386 |
| 4,390,063 | 6/1983 | Wells, Jr. | 166/84 |
| 4,512,410 | 4/1985 | Forester | 166/380 |
| 4,623,020 | 11/1986 | Nichols | 160/88 |
| 4,887,669 | 12/1989 | Paulus | 166/88 |

OTHER PUBLICATIONS

Composite Catalogue of Oil Field Equipment, pp. 541-544, 1990-91 Edition.

*Primary Examiner*—Ramon S. Britts
*Assistant Examiner*—Frank S. Tsay

[57] ABSTRACT

A geothermal well apparatus which includes the well casing head, the expansion spool, an improved hanger spool which both supports and allows communication to a tubing string through the hanger spool and a master valve which is positioned above the hanger spool so that the presence or absence of a tubing string within the well supported from the hanger spool will not prevent the operation of the master valve. This improved hanger spool structure allows the use of the injection tubing string support and communication thereto solely by and through the hanger spool. The hanger which supports the tubing string is landed within a pocket in the flow passage of the hanger spool and the weight of the string provides the setting force for the sealing means carried by the hanger. A holddown screw is included to retain the hanger in it landed and sealed position within hanger spool.

9 Claims, 4 Drawing Sheets

GEOTHERMAL WELL APPARATUS AND ECCENTRIC HANGER SPOOL THEREFOR

BACKGROUND

Geothermal wells have been drilled in the past to recover the internal earth heat by producing the steam resulting therefrom. Usually such wells have included a casing head at the surface which is surmounted by an expansion spool, one or more master control valves and when needed a lubricator connected at the top of the structure which allows the introduction of elements into the well bore through the lubricator without sacrificing the pressurized steam production.

Such geothermal wells have included a tubing string run through the interior of the casing. Such tubing string can be used for start-up of the well, for control, for corrosion control, for testing and for scaling control or other purposes. Prior to the present invention different means have been used for the introduction of a tubing string into the casing head or expansion spool and into the casing of a geothermal well. One such means has included an angled connection into the upper portion of the expansion spool or spool adapter which is oriented at a slight angle to the vertical so that a coil of tubing can be run in a manner similar to a wireline into the casing. Insertion of the coiled tubing into the casing involves substantial expense not only for the special coiled tubing but for the highly specialized equipment and services required to uncoil and insert the tubing. Such equipment and services is offered by several companies such as Bowen Tools, Inc. of Houston, Tex. Bowen's coiled tubing units are shown and described on pages 541 through 544 of the 1990–91 edition of the Composite Catalogue of Oil Field Equipment and Services (by Gulf Publishing Company, Houston, Tex.). Another disadvantage that geothermal well operators face because of coiled tubing is the increased height of the production tree due to the angled connection member. Also, the use of coiled tubing requires that the master control valve/valves be located below the angled connection member. This requires the use of expensive master valves with the capability of shearing the coiled tubing and sealing in an emergency.

U.S. Pat. No. 4,390,063 discloses a particular annular packing for a geothermal well which packing is used to seal the annulus surrounding the inner production casing. The well structure includes the well casing the inner production casing within the expansion spool, a master valve and other flow and control structures. There is no suggestion that there be a tubing string extending into the well casing with the improved hanger spool structure of the present invention.

U.S. Pat. No. 3,976,130 discloses a geothermal well together with a packing structure. There is no suggestion of any of the improved structures of the present invention. U.S. Pat. No. 4,512,410 discloses a geothermal expansion wellhead system. There is no suggestion in this reference of any of the improved structures of the present invention.

SUMMARY

The present invention relates to a geothermal well which has provision for the supporting a standard non-coiled tubing string therein in a eccentric hanger seat within a hanger spool. The spool is provided with an opening communicating directly with the bore of the hanger seat and communicates with a port in the hanger when it has been landed. The spool is positioned beneath the master valve or valves and the tubing depending therefrom extends downwardly within the casing. The hanger includes suitable sealing means which are activated by the weight of the tubing string supported thereon and is maintained in such position by a holddown screw so that pressure differentials exerted upwardly do not relax the seals. The interior of the spool includes the structure of the hanger pocket or seat and the flow area through which produced steam flows into the master valve.

An object of the present invention is to provide an improved geothermal wellhead structure including an injection tubing string which does not substantially increase the height of the tree.

Another object is to provide an improved geothermal wellhead structure which includes an injection tubing string which does not have to be sheared by the master valve in order for the valve to close.

Still another object is to provide an improved geothermal wellhead structure which allows an injection tubing string to be run or pulled while the well is producing.

A still further object is to provide an improved injection tubing hanger for a geothermal well in which the inclusion of a hanger seat does not appreciable restrict the flow area in the spool.

A further object is to provide an improved injection tubing hanger which is compatible with conventional geothermal well equipment.

Another object of the present invention is to provide an improved geothermal production tree that does not require the use of coiled tubing for injection or other uses.

BRIEF DESCRIPTION OF THE DRAWINGS

These and other objects and advantages of the present invention are hereinafter described and explained with reference to the drawings wherein.

DESCRIPTION OF THE PREFERRED EMBODIMENTS

Figure 1:
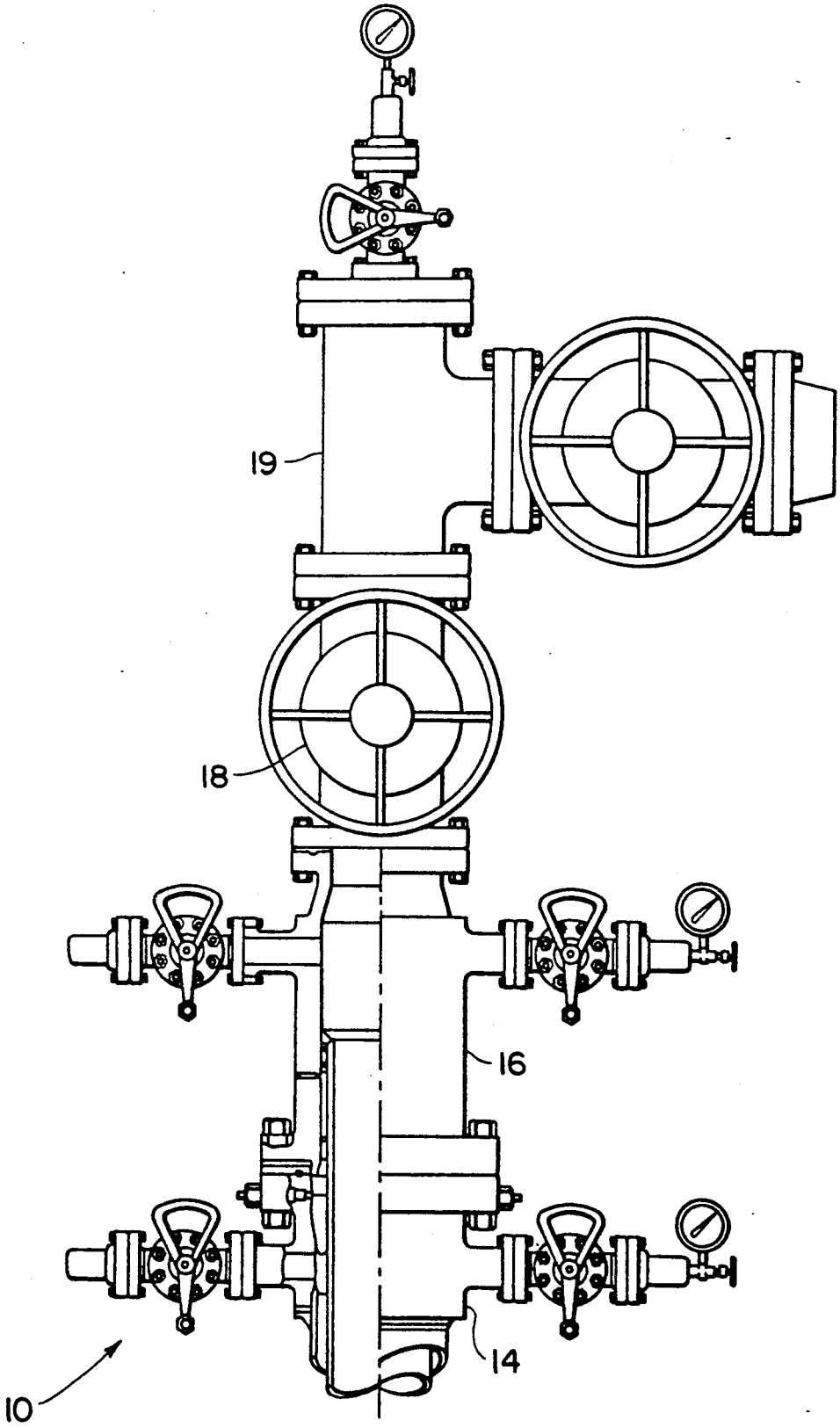
FIG. 1 is an elevation view, partly in section of a typical geothermal wellhead.
Figure 2:
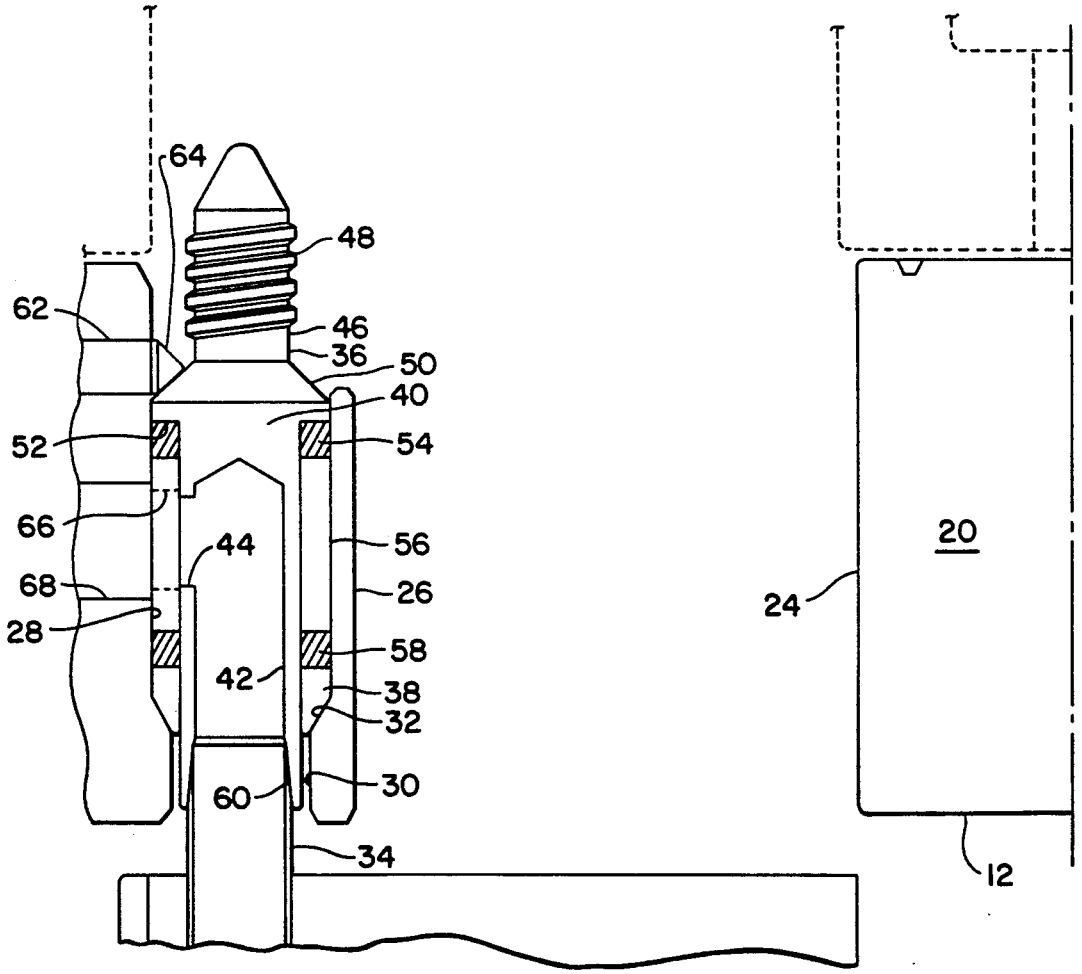
FIG. 2 is an axial sectional view of the improved hanger spool of the present invention with a tubing string being supported on a hanger landed in the hanger seat of the spool and showing the upper portion of the production casing immediately below the hanger spool and the lower portion of the master valve body immediately above the hanger spool.

The geothermal wellhead 10 illustrated in FIG. 1 is a structure to which the improved hanger spool 12 (shown in FIGS. 2 and 3) of the present invention can be applied as hereinafter shown. Wellhead 10 includes the casing head 14 which extends above the ground with expansion spool 16 secured thereto and master valve 18 secured above expansion spool 16. Both casing head 14 and master valve 18 are flanged with suitable openings for receiving studs extending from the structure to which they are to be secured. Suitable apparatus such as the tee 19 and other structure shown or a lubricator (not shown) may be connected above master valve 18. Hanger spool 12 includes a body 20 of substantial thickness so that studs may be received in upper and lower surfaces, i.e., studs can be threaded into threaded openings 22 in the top surface of body 20. Similar threaded openings (not shown) are provided in the lower surface of body 20 to allow attachment to the flange at the upper end of expansion spool 16. In the event that no expansion spool 16 is used in the particular well, hanger spool 12 may be secured directly between casing head 14 and master valve 18.

Figure 3:
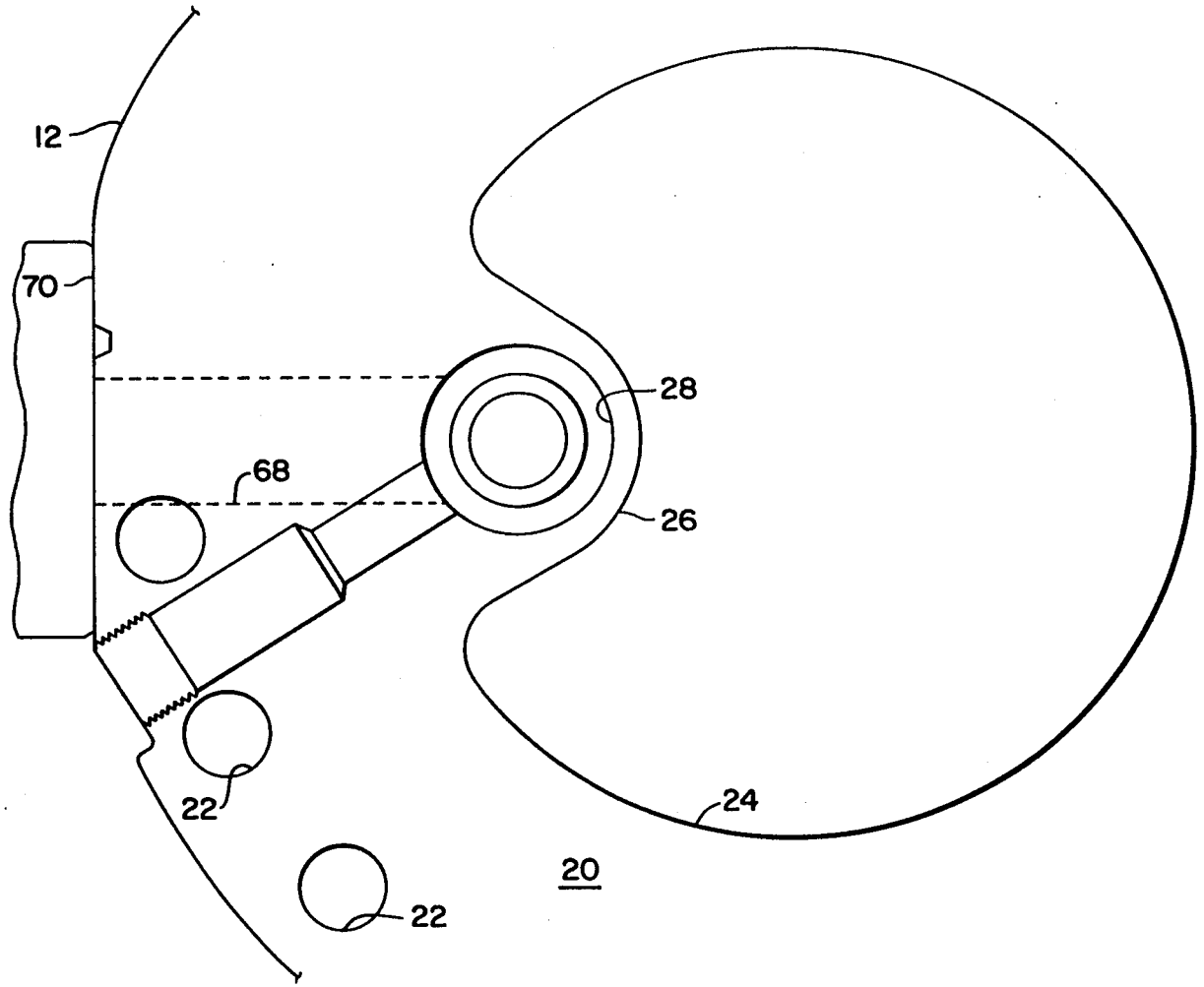
FIG. 3 is a plan view of the top of the improved hanger spool of the present invention showing the relationship of the holddown screw and the passage communicating with the tubing hanger landed within the seat in the improved hanger spool.

Hanger spool body 20 is generally annular in shape and has an internal flow passage 24 extending therethrough. Flow passage 24 as best seen in FIG. 3 is generally cylindrical over approximately three quadrants of its cross-section and has projection 26 extending inwardly to interrupt the remaining portion of the cross-section. Projection 26 is provided with bore 28 extending axially therethrough. The lower end of bore 28 is tapered inwardly to connect to smaller lower bore 30 and the tapered portion between the two bores 28 and 30 forms landing seat 32.

As can be seen from FIG. 3, bore 28 is positioned so that injection tubing 34 may be run from above through bores 28 and 30 and hanger 36 is landed within bores 28 and 30 with its lower or bottom adapter ring 38 being landed upon seat 32. Hanger 36 includes body 40 which includes axial bore 42 extending upwardly therein and terminating in communication with the inner end of radial bore 44. The exterior of body 40 includes upper neck 46 which includes suitable means, such as threads 48 or a fishing head, for connecting to a running tool (not shown), tapered surface 50 which tapers radially outwardly and downwardly and downwardly facing shoulder 52 which is positioned at the upper end of the lower reduced diameter portion of body 40. Upper resilient seal ring 54 is positioned around the reduced diameter portion of body 40 immediately under shoulder 52. Spacer ring 56 is positioned immediately below ring 54 and lower resilient seal ring 58 is positioned between the lower end of spacer ring 56 and the upper end of lower adapter ring 38. The lower portion of bore 42 is threaded to provide threads 60 which are engaged by the threads on the exterior of the upper end of injection tubing string 34.

Once hanger 36 has been landed, the weight of tubing string 34 is exerted on hanger 36 and through shoulder 52 compresses seal rings 54 and 58 into sealing engagement between the exterior of hanger 36 and the interior of bore 28 above landing seat 32. When hanger 36 is fully seated, suitable means for securing hanger 36 in its position is provided. As shown in the drawings, such means includes holddown screw 62 which is threaded inwardly so that its tapered end 64 is in engagement with tapered surface 50 to retain hanger 36 in its landed and sealed position even if the weight of tubing string 34 is relieved by the pressure which can occur within the wellhead 10. It should be noted that spacer ring 56 includes opening 66 extending therethrough so that radial bore in hanger 36 is in communication through opening 66 with radial passage 68 extending through body 20 of hanger spool 12. It should be noted that since casing head 14 will be above ground that running of a tubing string 34 and hanger 36 will not require any special orientation to cause the opening 66 through spacer ring 56 to register with both passage 68 in spool body 20 and opening 66 in hanger body 42. If this should be a problem, for example, if it is desired to run the tubing string 34 while the well is producing, then spacer ring 56 should be desired to have an internal and an external channel to ensure the desired flow. Since the annulus is sealed above and below spacer ring 56, the desired flow will take place as long as there is a channel communicating to and from the spacer ring opening 66. By using this communicating structure the tubing string 34 and its hanger 36 may be run into the well through a lubricator while the well is flowing.

The external area of spool body 20 surrounding passage 68 is provided with a flat surface 70 for connecting suitable flanged conduit thereto for the delivery of fluids to be delivered through tubing string 34 into the lower portion of the well.

Since the position of the pocket within the hanger spool 12 provides a passage for tubing string 34 which is within the flow passage both below and above hanger spool 12, there is no difficult with respect to sticking or damaging the tubing in the running or retrieval of the tubing string 34. This hanger spool 12 while slightly increasing the height of the wellhead structures does not require the substantial increase in height which results from using the angled inlet described above. Also, since the hanger spool 20, hanger 36, tubing string 34 and the passages communicating therebetween are all below master valve 18, master valve 18 may be closed at any time without interfering with the operation of the tubing string.

Figure 4:
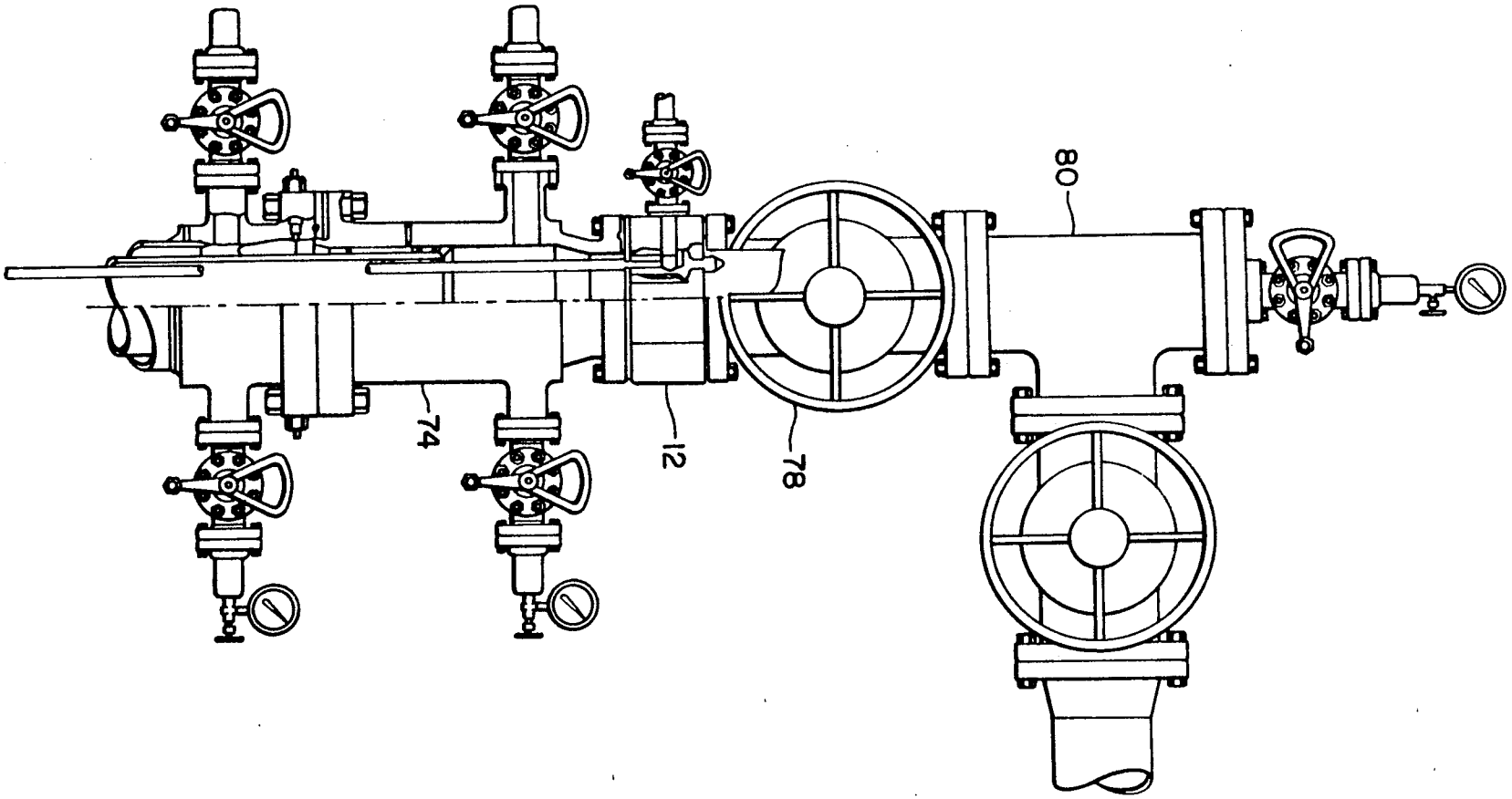
FIG. 4 is an elevation view partly in section of the improved hanger spool of the present invention installed in a geothermal wellhead.

As shown in FIG. 4, improved hanger spool 12 is installed on geothermal wellhead 72. Expansion spool 74 is secured to the upper end of casing head 76 and hanger spool 12 is positioned on the upper end of expansion spool 74 with lower master valve 78 being secured to the upper end of hanger spool 12. The remainder of the wellhead equipment is secured to tee 80 as shown and tee 80 is secured to the upper end of lower master valve 78.

FIG. 4 illustrates the space provided from tubing string 34 both above and below hanger spool 12 so that it is not bent or otherwise damaged in running or retrieval. Hanger spool 12 has a relatively small vertical dimension so that it does not appreciably increase the height of the wellhead structures. Further as can be seen from FIG. 4 the placement of lower master valve 78 above spool 12 allows it to be closed at any time without interfering with the operation of tubing string 34.

What is claimed is:

1. A geothermal well apparatus comprising a casing head mounted on the upper end of a casing string, a hanger spool having an internal flow passage with a landing pocket positioned in a eccentric position within said internal flow passage in said spool, a master valve, means for securing said hanger spool to and above said casing head and to and below said master valve, said landing pocket having means for supporting a tubing hanger therein with a tubing string depending therefrom, and means for delivering a fluid from the exterior of said hanger spool into a tubing string supported in said hanger spool landing pocket, said hanger spool internal flow passage having substantially the same flow area as the master valve and the casing head.

2. A geothermal well apparatus according to claim 1 wherein said means for delivering a fluid includes a passage extending radially through said hanger spool into a position within said pocket, a hanger supported within said hanger spool landing pocket and having means for connecting a tubing string on its lower end and a passage communicating with the tubing string and with the radially extending passage through the hanger spool.

3. A geothermal well apparatus according to claim 2 including sealing means carried by said hanger for sealing against the interior surface of said spool pocket when said hanger is landed within said pocket.

4. A geothermal well apparatus according to claim 3 wherein said sealing means is activated by the weight of the tubing string supported by said hanger.

5. A geothermal well apparatus according to claim 3 including means for securing said hanger in its landed and sealed position within said pocket.

6. A geothermal well apparatus according to claim 5 wherein said securing means includes a holddown screw extending through said hanger spool and engaging said hanger to secure it within said hanger spool landing pocket.

7. As a subcombination for use with a geothermal well apparatus, the combination including a hanger spool having a flow passage extending axially therethrough and with a hollow pocket projecting into said passage, a hanger for supporting a tubing string, said pocket adapted to receive and land said hanger within said pocket, said hanger having an exterior surface, said pocket having an interior surface, sealing means carried by said hanger for sealing between the exterior of the hanger and the interior of said pocket when said hanger is positioned within said pocket, a passage through said hanger spool communicating with the interior of said pocket, a passage through said hanger communicating between a tubing string supported thereby and said hanger spool passage.

8. The subcombination according to claim 7 including means on said hanger for engagement by a running or retrieving tool.

9. The subcombination according to claim 7 wherein said sealing means between said hanger and said pocket is set by the weight of the tubing string supported by said hanger after it has landed within said pocket.

* * * * *